US012767392B2

(12) United States Patent
Richmond

(10) Patent No.: US 12,767,392 B2
(45) Date of Patent: Oct. 20, 2026

(54) CONTAINER OR VESSEL HAVING AN ANTI-SPLASH DEVICE AND AN ANTI-SPLASH DEVICE FOR A CONTAINER OR A VESSEL

(71) Applicant: Derek Richmond, McLean, VA (US)

(72) Inventor: Derek Richmond, McLean, VA (US)

( * ) Notice: Subject to any disclaimer, the term of this patent is extended or adjusted under 35 U.S.C. 154(b) by 0 days.

(21) Appl. No.: 18/906,115

(22) Filed: Oct. 3, 2024

(65) Prior Publication Data

US 2025/0026543 A1 Jan. 23, 2025

Related U.S. Application Data

(63) Continuation of application No. 17/597,598, filed as application No. PCT/US2021/024727 on Mar. 29, 2021, now Pat. No. 12,110,154.

(60) Provisional application No. 63/021,657, filed on May 7, 2020.

(51) Int. Cl.

| | |
|---|---|
| ***B65D 43/02*** | (2006.01) |
| ***A47G 19/22*** | (2006.01) |
| ***B65D 51/16*** | (2006.01) |
| ***B65D 51/18*** | (2006.01) |

(52) U.S. Cl.

CPC ..... *B65D 43/022* (2013.01); *A47G 19/2272* (2013.01); *B65D 51/1605* (2013.01); *B65D 51/18* (2013.01); *B65D 2251/0018* (2013.01); *B65D 2251/0081* (2013.01); *B65D 2543/00046* (2013.01); *B65D 2543/00092* (2013.01); *B65D 2543/0049* (2013.01); *B65D 2543/00546* (2013.01); *B65D 2543/00972* (2013.01)

(58) Field of Classification Search

CPC ..... B65D 41/18; B65D 43/0212; B65D 55/16
USPC ..... 215/228, 212; 220/744, 212, 784, 799, 220/713, 521, 780, 793; 229/404, 906.1
See application file for complete search history.

(56) References Cited

U.S. PATENT DOCUMENTS

| | | | | | |
|---|---|---|---|---|---|
| 1,519,100 | A | * | 12/1924 | Allums | B65D 51/243 215/304 |
| 3,255,910 | A | * | 6/1966 | Winston | B65D 51/223 215/311 |
| 4,592,483 | A | * | 6/1986 | Scouten | B65D 39/00 220/744 |
| 5,050,759 | A | * | 9/1991 | Marble | A47G 19/2272 220/711 |
| 5,148,937 | A | * | 9/1992 | Huard | B65D 51/223 220/267 |
| 5,797,506 | A | * | 8/1998 | Lehmkuhl | B65D 51/223 215/232 |
| 6,024,234 | A | * | 2/2000 | Rink | B65D 51/223 215/250 |
| 6,148,958 | A | * | 11/2000 | Ahl | E06C 7/14 248/210 |

(Continued)

*Primary Examiner* — Prince Pal

(57) ABSTRACT

A drinking vessel may include a tumbler having an inner surface dimension, a first portion, and a second portion. The first portion may include a proximal surface having a first dimension and a first rim coupled to the proximal surface and having a second dimension, the first dimension being larger than the second dimension. The second portion may include a collar having an outer dimension substantially similar to the first dimension, an inner dimension substantially similar to the second dimension, and a second rim connected to the collar and having an outer dimension substantially similar to the second dimension and the inner surface dimension.

16 Claims, 8 Drawing Sheets

(56) References Cited

U.S. PATENT DOCUMENTS 7,025,312 B1 * 4/2006 Dare ..... A47J 47/16 220/744
7,673,767 B2 * 3/2010 Vovan ..... B65D 43/0229 220/744
7,997,442 B2 * 8/2011 Pinelli ..... A47G 19/2272 220/714
D692,762 S * 11/2013 Walter ..... D9/504
8,733,567 B1 * 5/2014 Dopps ..... B65D 41/02 215/256
9,078,535 B1 * 7/2015 Buck ..... B65D 43/169
9,114,917 B1 * 8/2015 Salem ..... B65D 47/043
9,241,588 B2 * 1/2016 Dunn ..... A47G 19/2272
9,340,333 B2 * 5/2016 Polt ..... A47G 19/2272
9,605,790 B1 * 3/2017 Alonzo ..... F16M 11/00
9,725,214 B2 * 8/2017 Crosby ..... B65D 43/0212
9,834,346 B1 * 12/2017 Ferraro ..... B65D 51/224
10,377,540 B2 * 8/2019 Borgardt ..... B65D 50/041
10,486,871 B2 * 11/2019 Ramey ..... B65D 55/16
D876,226 S * 2/2020 Marshall ..... D9/624
10,583,965 B2 * 3/2020 Walsak ..... B65D 45/24
11,006,772 B1 * 5/2021 Allen ..... A47G 19/2227
11,083,297 B1 * 8/2021 Alonzo ..... A47B 97/04
11,160,404 B2 * 11/2021 Johnson ..... B65D 81/3876
11,241,110 B2 * 2/2022 Cudworth ..... F16K 7/12
11,246,449 B2 * 2/2022 Mader ..... A47J 36/12
D1,034,191 S * 7/2024 Marshall ..... D9/436
D1,066,015 S * 3/2025 Marshall ..... D9/434
2004/0262323 A1 * 12/2004 Cha ..... A47G 19/065 220/709
2005/0173434 A1 * 8/2005 O'Neal ..... B65D 43/0212 220/379
2007/0039915 A1 * 2/2007 Jackel ..... B65D 47/0838 220/744
2007/0051738 A1 * 3/2007 Slayton ..... B65D 47/06 220/744
2008/0078686 A1 * 4/2008 Vovan ..... B65D 21/0237 220/501
2012/0199548 A1 * 8/2012 Kitto ..... B65D 55/16 215/316
2012/0312816 A1 * 12/2012 Barreto ..... A47G 19/2272 220/254.9
2013/0056467 A1 * 3/2013 Shepard ..... B65D 47/249 220/254.9
2013/0233898 A1 * 9/2013 Resnikoff ..... B65D 43/0202 222/568
2013/0334241 A1 * 12/2013 Abdi ..... B65D 43/0212 220/837
2014/0001189 A1 * 1/2014 Savenok ..... B65D 47/265 220/592.17
2014/0319138 A1 * 10/2014 Polt ..... B65D 43/0227 220/254.3
2015/0190003 A1 * 7/2015 Kelaher ..... A47G 19/2272 220/303
2016/0000245 A1 * 1/2016 Sims ..... B65D 47/0871 220/253
2016/0065705 A1 * 3/2016 Nam ..... H04M 1/04 455/575.8
2016/0075492 A1 * 3/2016 Brannock ..... B65D 43/0212 220/712
2016/0272384 A1 * 9/2016 Lee ..... A47G 19/2272
2017/0020317 A1 * 1/2017 Green ..... A47G 19/2272
2017/0273483 A1 * 9/2017 McArthur ..... B65D 51/28
2018/0050845 A1 * 2/2018 Chin ..... A47J 41/0016
2018/0194524 A1 * 7/2018 Chalermwinsuekun ..... A47G 19/2272
2018/0229905 A1 * 8/2018 Ramey ..... A47G 19/22
2018/0305094 A1 * 10/2018 Borgardt ..... B65D 51/228
2019/0053649 A1 * 2/2019 Novak ..... A47G 19/2266
2019/0261795 A1 * 8/2019 Savenok ..... A47G 19/22
2019/0263573 A1 * 8/2019 Taylor ..... B65D 47/286
2019/0375559 A1 * 12/2019 Spivey ..... B65D 43/0229
2020/0017260 A1 * 1/2020 Migas ..... B65D 43/162
2020/0359816 A1 * 11/2020 Renz ..... B65D 47/32
2020/0367678 A1 * 11/2020 Harris ..... B65D 81/3874
2020/0383505 A1 * 12/2020 Rees ..... A47G 19/2272
2021/0276768 A1 * 9/2021 Ziegler ..... A45C 11/00
2021/0300645 A1 * 9/2021 Zammori ..... B65D 55/16
2022/0153480 A1 * 5/2022 Mayer ..... B65D 41/3428
2022/0411161 A1 * 12/2022 Morris, III ..... B65D 81/2038
2023/0012382 A1 * 1/2023 Vang ..... A47G 19/2272
2023/0050778 A1 * 2/2023 Richmond ..... B65D 51/1605
2023/0255377 A1 * 8/2023 Roaks ..... A47G 19/2272 220/212.5
2023/0264860 A1 * 8/2023 Given ..... B44D 3/14 220/760
2023/0286691 A1 * 9/2023 Miller ..... B65D 1/24
2023/0382605 A1 * 11/2023 Harris ..... A47G 19/2211
2023/0399156 A1 * 12/2023 Chen ..... B65D 21/086
2024/0067422 A1 * 2/2024 Berroa García ..... B65D 55/16
2025/0026543 A1 * 1/2025 Richmond ..... B65D 43/022

* cited by examiner

CONTAINER OR VESSEL HAVING AN ANTI-SPLASH DEVICE AND AN ANTI-SPLASH DEVICE FOR A CONTAINER OR A VESSEL

CROSS-REFERENCE TO RELATED APPLICATIONS

The application is a continuation application of U.S. patent application Ser. No. 17/597,598, filed Jan. 12, 2022 and claims the benefit of International Application No. PCT/US2021/024727 filed Mar. 29, 2021, which claims the benefit of provisional U.S. Patent Application No. 63/021,657 filed May 7, 2020, the contents of each of which are hereby incorporated in their entirety.

FIELD

The present disclosure relates to an anti-splash device for a container or a vessel having and an anti-splash device.

BACKGROUND

This section provides background information related to the present disclosure, which is not necessarily prior art. The following description is not an admission that any of the information provided herein is prior art or that any publication specifically or implicitly referenced is prior art.

The olfactory perception of consumers is an important factor to consider when developing a certain beverage. Oral taste relies heavily on the sense of smell. Through the sense of smell, consumers can enjoy a beverage. A pleasant aroma can induce consumers into trying the beverage and the overall experience can be enhanced by consuming the beverage with the combination of a pleasant smell and taste. Unfortunately, many consumers on the go are deprived of this olfactory experience because containers have lids that fail to provide a means to trigger the olfactory experience with the aroma of the beverage.

WO 2011/082333 to Sprunger discloses a beverage lid that has a pod (e.g., compartment) filled with aromatic material (e.g., coffee grind). The lid allows vapor rising from a hot beverage to pass through the aroma pod and to the user's nose. Unfortunately, this approach can be problematic if the aromatic material is accidentally wetted while filling the beverage container or while drinking from the beverage container. In addition, the lid is relatively large and expensive since it requires a pod with an aromatic material.

A similar approach is described in WO 2009/126555 to Kaufman, which discloses a beverage lid that has a compartment for holding a sample of fresh beverage material. The compartment is placed near the user's nose, allowing the user to smell the beverage material when drinking from the lid. While the Kaufman lid can provide a pleasant aroma of fresh material, this approach is troublesome for those consumers that desire repeated use.

In another approach, GB 2473041 and GB 2473042 both to Brown disclose a cup lid having a curved rim surface that is higher at the drinking aperture. The beverage flows through a liquid guide trough, which exposes the liquid to the air adjacent to the user's nose. Unfortunately, a user may run the risk of burning his/her upper lip because the lid's curved rim surface places the user's upper lip into the flow of the beverage in the guide trough. Brown also fails to provide a controlled beverage flow rate and a comfortable/secure feeling for drinking hot beverages. Furthermore, these publications fail to contain and redirect the aroma to a concentrated point near the user's nose.

U.S. Patent Application Publication No. 2011/0114655 to Bailey provides a cup lid that has two apertures, one of which is positioned on a ridge that bisects the lid. This approach increases the risk of spilling via the additional aperture and fails to allow the beverage to aerate outside of the container as it flows to the user's mouth.

In U.S. Pat. No. 8,881,938 to Brannock ("Brannock") the primary problem that Brannock satisfies is spillage prevention, e.g., enhancing an olfactory experience is done without affecting the desire to avoid spillage. Brannock neglects the need to promote a concentrated collection of vapor from the coffee and direction of that vapor to the nose to enhance the drinking experience. Brannock prioritizes anti-spillage over vapor concentration.

Thus, there is still a need for improved lids that enhance the olfactory experience of drinking an aromatic beverage and that provide better comfort and protection when drinking hot beverages.

SUMMARY

This section provides a general summary of the disclosure and is not a comprehensive disclosure of its full scope or all of its features.

Some embodiments of the inventive subject matter may be directed toward a lid for a container. The lid may include a first portion and a second portion. The first portion may include a proximal surface having a first-dimension value and a first rim coupled to the proximal surface and having a second-dimension value. The first-dimension value may be larger than the second-dimension value. The second portion may be configured to receive the first portion in a nested relationship and may include a collar having an outer dimension value substantially similar to the first dimension value and an inner dimension value substantially similar to the second dimension value and a second rim connected to the collar and having an outer dimension value substantially similar to the second dimension value.

Embodiments may include a baffle defining a first through-hole at a central region of the baffle and at least partially in contact with the collar at an edge of the baffle and at least partially surrounded by the collar. The baffle may have a partial toroid cross-section and define a second through-hole at the edge of the baffle. A flap may be connected to the baffle at the second through-hole and may be configured to at least partially impede fluid flow through the second through-hole. The flap may be connected at a connection point to the baffle at a first angle defined by the connection point as a first vertex, the edge of the baffle, and the flap. The first angle may be smaller than a second angle that is defined by the connection point as a second vertex, the edge of the baffle, and a proximal rim of the second portion.

Embodiments may include a groove and ribs defined by the proximal surface of the first portion. The ribs may extend into the groove from the proximal surface. The defined groove may be configured to matingly receive a proximal rim of the second portion and clip the first portion to the proximal rim of the second portion.

Further embodiments may be directed toward a drinking vessel including a tumbler, a first portion and a second portion. The tumbler may include an inner surface dimension value. The first portion may include a proximal surface having a first-dimension value and a first rim coupled to the proximal surface and having a second-dimension value. The first-dimension value may be larger than the second-dimension value. The second portion may be configured to receive the first portion in a nested relationship and may include a collar having an outer dimension value substantially similar to the first dimension value and an inner dimension value substantially similar to the second dimension value. A second rim may be connected to the collar and may have an outer dimension value substantially similar to the second-dimension value and the inner surface dimension value.

The drinking vessel may include a baffle at least partially in contact with the collar at an edge of the baffle and at least partially surrounded by the collar. The baffle may define a first through-hole at a central region of the baffle and a second through-hole at the edge of the baffle. The baffle may have a partial toroid cross-section. A flap may be connected to the baffle at the second through-hole and may be configured to at least partially impede fluid flow through the second through-hole.

Yet further embodiments may be directed toward a lid for a container including a substrate having a first surface and a second surface, a rim coupled to the first surface of the substrate and a groove defined by the substrate. The first surface may oppose the second surface. The defined groove may be arcuately defined in the second surface of the substrate and may be configured to receive a rim of a drinking vessel. A spring for biasing the defined groove toward or away from a closed position may be included in the lid.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible embodiments and are not intended to limit the scope of the present disclosure.

Corresponding reference numerals indicate corresponding parts throughout the several views of the drawings.

DETAILED DESCRIPTION

Figure 1:
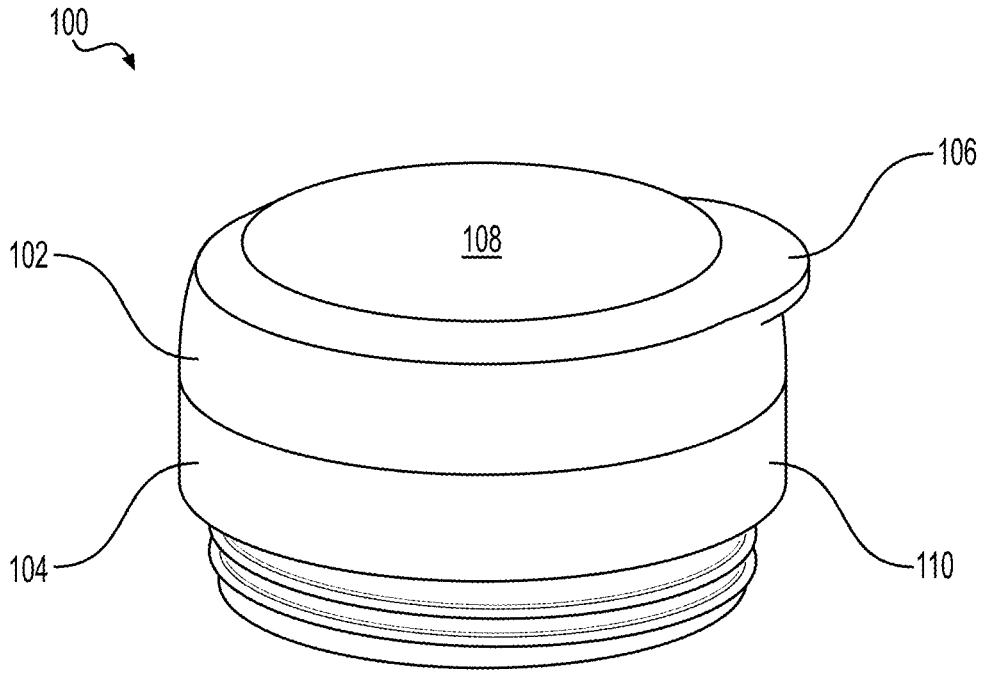
FIG. 1 illustrates an embodiment of the present subject matter.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The following embodiments are examples of the inventive subject matter. Any element not suggested by, not disclosed and/or not recited in the following embodiments or appended claims is not essential to the inventive subject matter. Any element recited in the following embodiments and appended claims is not, by virtue of its inclusion, essential. Any element of the present disclosure may be replaced with any other equivalent element. For example, where the term "may" is used, a specific element may or may not be included in the inventive subject matter. Where elements are not referred to as optional, i.e., by using the term "may," that element is not necessarily essential to practicing the claimed invention.

FIG. 1 illustrates an embodiment of an anti-splash device, i.e., a lid, 100, which may have two portions, a first portion 102 and a second portion 104. The first portion 102 is illustrated as having a shape that is substantially circular; however, the first portion 102 may have a shape that is circular, triangular, square, polygonal, or irregular. The first portion 102 may include a tab 106 and a proximal surface 108.

The second portion 104 may include a collar 110. The second portion 104 is illustrated as having a substantially circular cross-section; however, the second portion 104 may have a cross-section that is circular, triangular, square, polygonal, or irregular. The second portion 104 is illustrated as having a cross-section that corresponds with, i.e., substantially identical to, the cross-section of the first portion 102. However, it is not necessary, that the second portion 104 have a substantially identical cross-section to the cross-section of the first portion 102; the second portion 104 may have a cross-section substantially different and independent from the cross-section of the first portion 102.

Figure 2A:
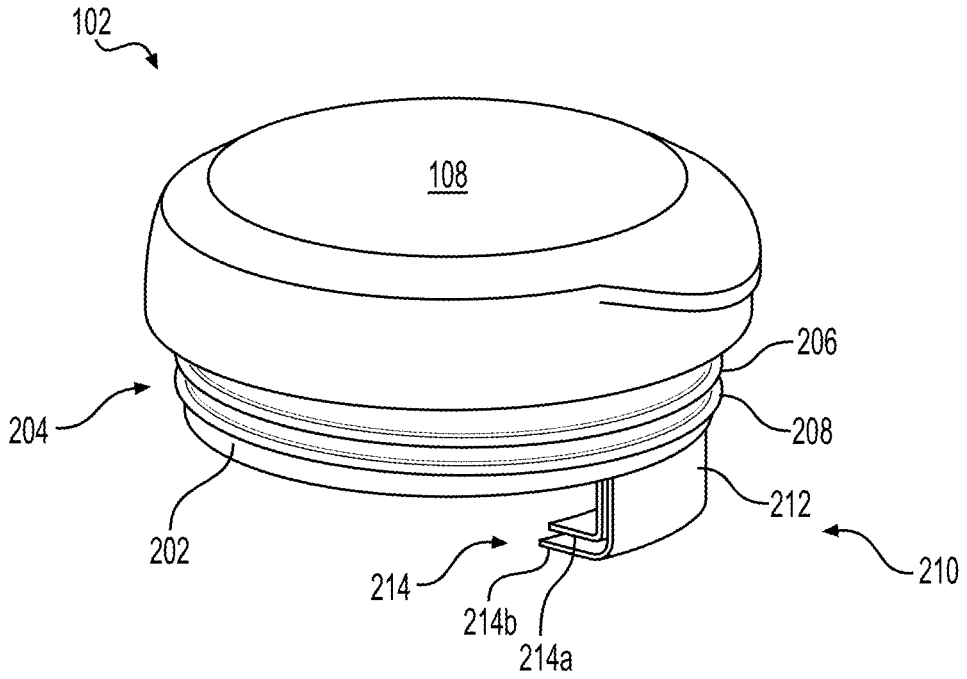
FIG. 2A illustrates a first view of a first portion of the embodiment illustrated in FIG. 1.
Figure 2B:
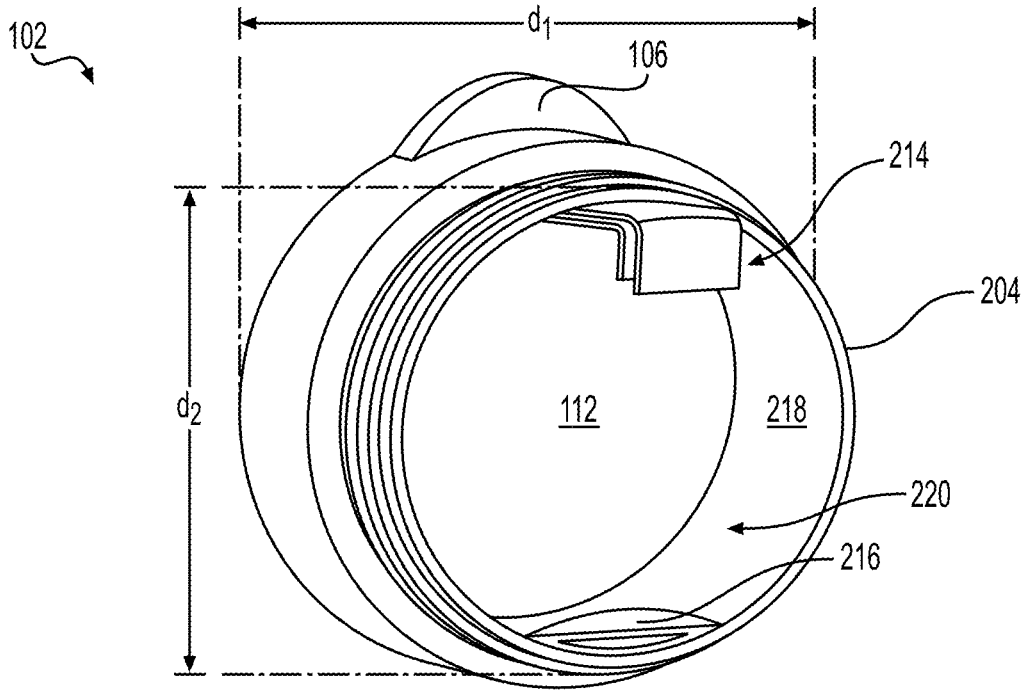
FIG. 2B illustrates a second view of the first portion of the embodiment illustrated in FIG. 1.

FIGS. 2A and 2B illustrate the first portion 102. The first portion 102 may include a first rim 202 coupled to an inner surface 112. The first rim 202 may include a seal 204. The seal 204 may be a single O-ring seal, a double O-ring seal, as illustrated in FIG. 2, or a multiple (i.e., a triple or more seal) O-ring seal. For example, a double O-ring seal may have two contact rings—a first contact ring 206 and a second contact ring 208—that contact an interior surface of a drinking container, e.g., a cup, to prevent fluid from spilling from the container when the lid 100 engages the container. Other embodiments may include a threaded first rim 202 having a ring that rests against the inner surface 112 where the first rim 202 meets the inner surface 112 and outside of the first rim 202 to engage a container. Other fastening and sealing configurations are also possible. The O-ring 204 may be resilient such that it may return to its original shape after having pressure applied to it.

As illustrated in FIG. 2B, the inner surface 112 may have a first-dimension value, e.g., a diameter, $d_1$, and the first rim 202 may have a second dimension value, e.g., a diameter, $d_2$ (exclusive of seal 204). The diameter $d_1$ of the inner surface 112 may be larger than the diameter $d_2$ of the first rim 202. The first portion 102 may engage the second portion 104 in a nested configuration. For example, the first rim 202 may engage within and be secured by the collar 110. The dimension value may be a measurement of the diameter, length, circumference, etc. of the inner surface or first rim or any other measurable feature of the lid 100.

A clip 210 may extend from the inner surface 112 or from the first rim 202. The clip may have an L-shaped cross-section and may include a first portion 212 and a second portion 214. The first section 212 may be a substantially planar surface. The second portion 214 may be a substantially planar surface that is substantially perpendicular to the first portion 212. The second portion 214 may include multiple prongs. For example, FIG. 2A illustrates a first prong 214*a* and a second prong 214*b*. The clip 210 may be in a same region of the first portion 102 as the tab 106.

A condensation barrier 216 may be included on an interior collar surface 218 of the collar 110. The condensation barrier 216 may be substantially diametrically opposite a position of the clip 210. The condensation barrier 216 may be a planar member or a ramp-like member. The condensation barrier 216 may form a condensation cavity 220 along with the inner collar surface 218.

Figure 3A:
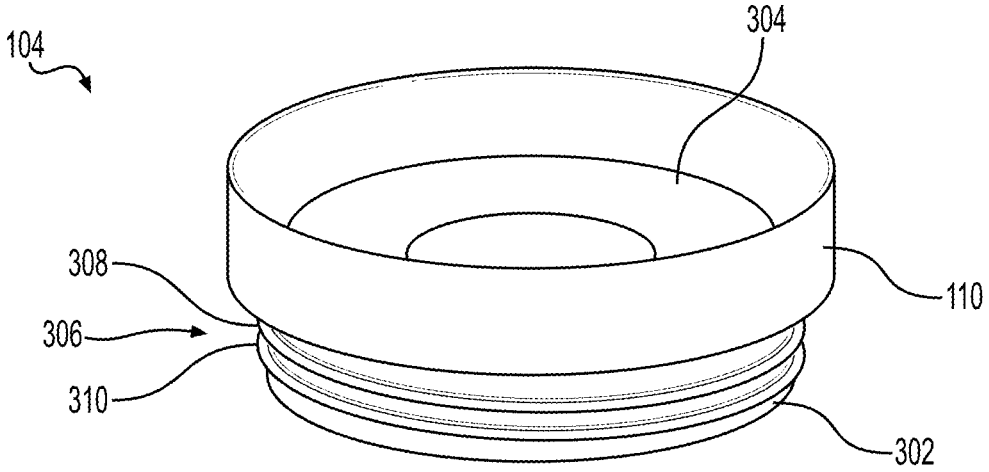
FIG. 3A illustrates a first view of a second portion of the embodiment illustrated in FIG. 1.
Figure 3B:
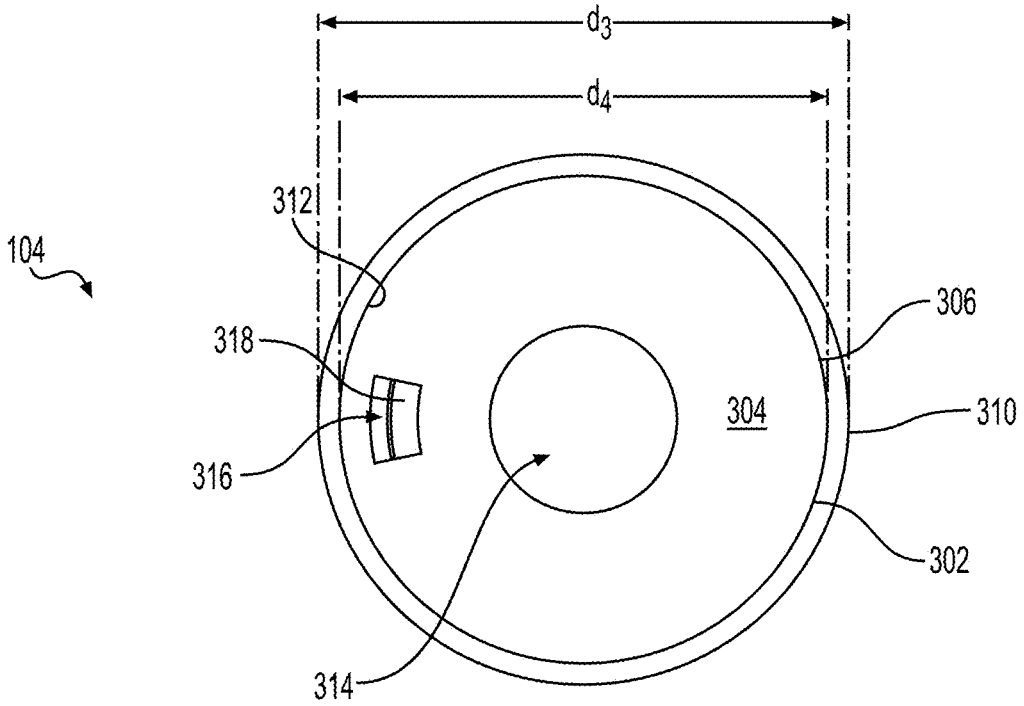
FIG. 3B illustrates a second view of the second portion of the embodiment illustrated in FIG. 1.
Figure 3C:
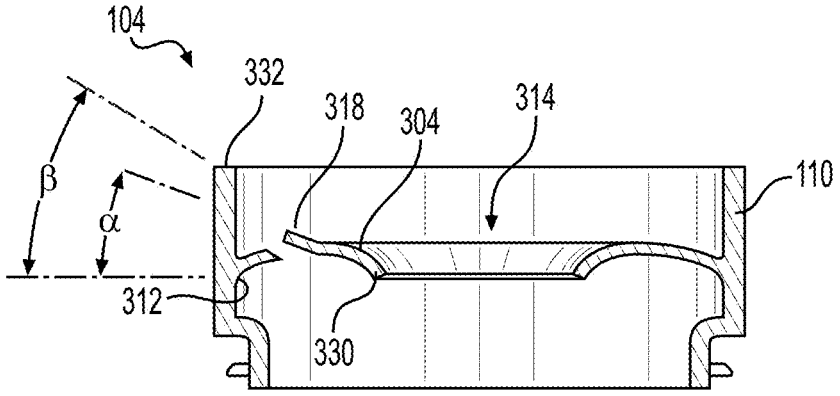
FIG. 3C illustrates a cross-sectional view of the second portion of the embodiment illustrated in FIG. 1.

FIGS. 3A-3C illustrate the second portion 104. The second portion 104 may include the collar 110, a second rim 302 and a baffle 304. A seal 306 may be included on or near the second rim 302. The seal 306 may be a single O-ring seal, a double O-ring seal, as illustrated in FIG. 3A or a multiple O-ring seal. For example, a double O-ring seal may have two contact rings—a first contact ring 308 and a second contact ring 310—that contact an interior surface of a container, e.g., a cup, to prevent fluid from spilling from the container. Other embodiments may include a threaded second rim 302 having a ring (not shown) that rests against the collar 110 where the second rim 302 meets the collar 110 and outside of the second rim 302 to engage a container. Other fastening and sealing configurations are also possible. The O-ring may be resilient such that it may return to its original shape after having pressure applied to it.

As illustrated in FIG. 3B, the collar 110 may have a third dimension value, e.g., an outer diameter, $d_3$ and the second rim 302 may have a fourth dimension value, e.g., an inner diameter, $d_4$ (exclusive of seal 306). The diameter $d_3$ of the collar 110 may be larger than the diameter $d_4$ of the second rim 302. The diameter $d_1$ of the proximal surface may be substantially similar to the diameter $d_3$ of the collar 110 and the diameter $d_2$ of the first rim 202 may be substantially similar to the diameter $d_4$ of the second rim 302. Thus, the first portion 102 may be interchangeable with the second portion 104 in engaging and sealing a container. Any and/or all of the dimension values may be a measurement of the diameter, length, circumference, etc. of the collar or any other measurable feature of the lid 100.

The baffle 304 may be connected to the collar at an edge 312 of the baffle 304 to the collar 110. The baffle 304 may define a vent 314, i.e., a first through-hole. In some embodiments, the first through-hole 314 may be at a central region of the baffle 304. In other embodiments, the first through-hole may be offset from the central region of the baffle 304.

The baffle 304 may define a second through-hole 316. The second through-hole 316 may be at or near the edge 312 of the baffle 304. A flap 318 may be attached to the baffle 304 at or near an edge of the defined second through-hole 316. The second through-hole 316 may be provided to allow a person to drink the contents of the container.

FIG. 3C illustrates a cross-section of the second portion 104. The second portion 104 may include two angles. A first angle $\alpha$ may be formed by a first line drawn from an inner edge 330 of the baffle 304 that defines the first through-hole 314 to the edge 312 of the baffle 304 and a second line drawn from the inner edge 330 of the baffle 304 through the flap 318. The inner edge 330 may be the vertex of the first angle $\alpha$.

A second angle $\beta$ may be formed by the first line drawn from an inner edge 330 of the baffle 304 that defines the through-hole 314 to the edge 312 of the baffle 304 and a third line from the inner edge 330 of the baffle 304 to a proximal edge 332 of the collar 110. The inner edge 330 may be the vertex of the second angle β. The first angle α may be smaller than the second angle β.

Figure 4A:
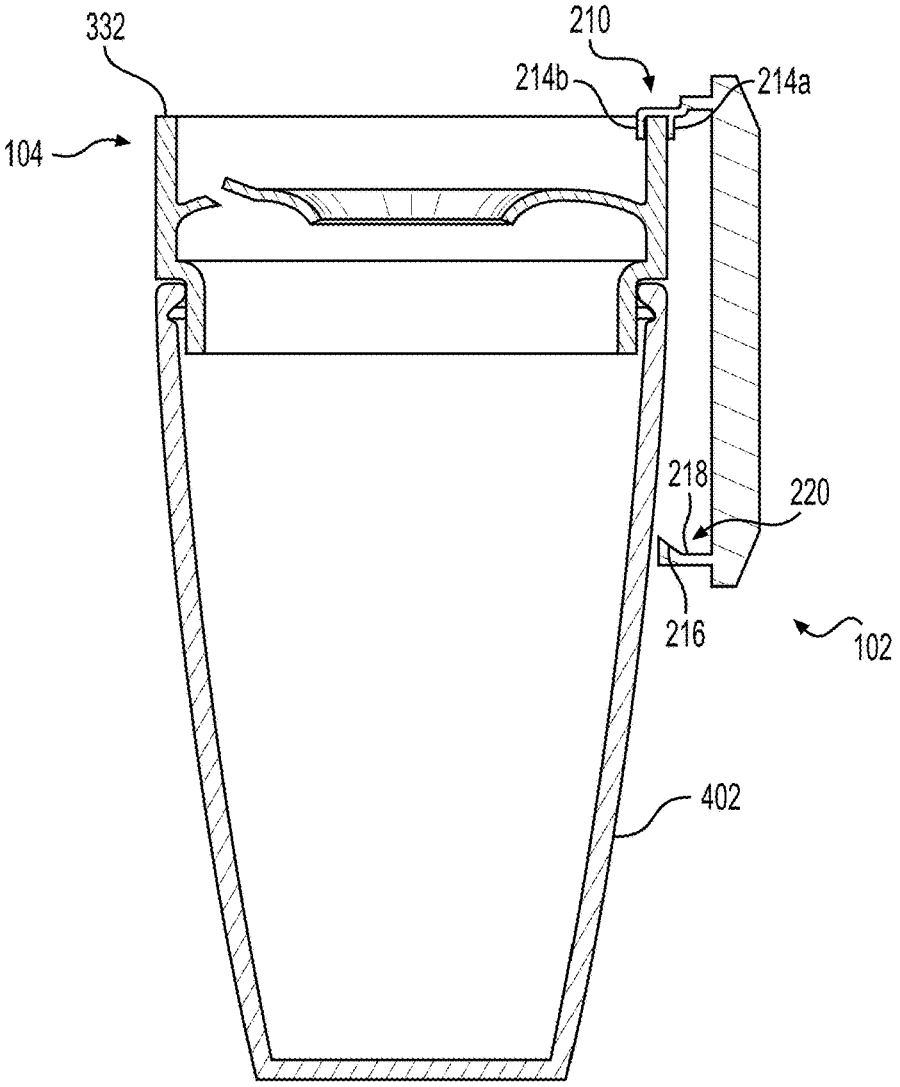
FIG. 4A illustrates a cross-sectional view of the embodiment of FIG. 1 in an alternate configuration.

FIG. 4A illustrates a cross-section of the first portion 102 and the second portion 104 attached to a drinking vessel 402. The first portion 102 and the second portion 104 may be attached to the vessel 402 in the configuration illustrated in FIG. 1, e.g., a nested configuration. The second portion 104 may be attached directly to the vessel 402, i.e., without the second portion 104 intervening between the first portion 102 and the second portion 104.

The first portion 102 may be attached to the second portion 104 by the clip 210. For example, the prongs 214*a* and 214*b* may engage the proximal edge 332 of the collar 110 to lock the first portion 102 to the second portion 104. The locked first and second portions 102 and 104 may be in a substantially perpendicular configuration based on first and third dimension values, $d_1$ and $d_3$, relative to each other. When locked, the locked first and second portions 102 and 104 may be in tight enough engagement to prevent substantial displacement between the portions 102 and 104 relative to each other. The locked first and second portions, 102 and 104, may allow displacement of the lid 100 in one or two directions, e.g., axial and longitudinal directions, axial and rotational directions, longitudinal and tilt directions, etc. In some embodiments, the tab 210 is at a same region as the tab 106, which provides easier placement of the first portion 102 on the second portion 104.

Figure 4B:
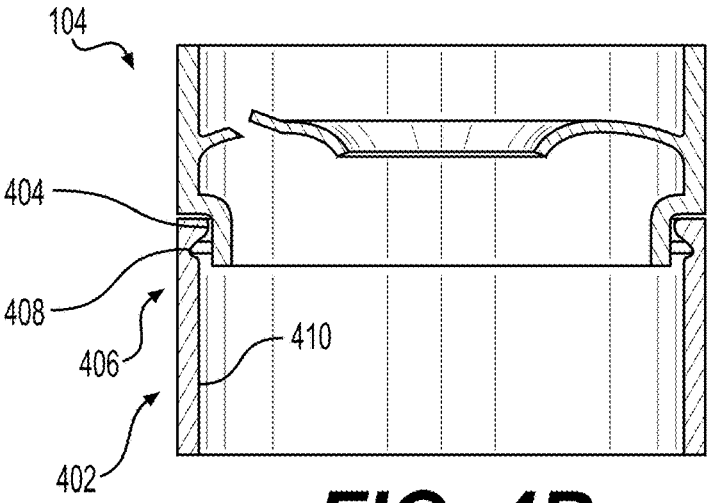
FIG. 4B illustrates a cross-sectional view of the second portion of the embodiment illustrated in FIG. 1 and a vessel.

FIG. 4B illustrates a partial cross-sectional view of an engagement between the second portion 104 with the vessel 402. As illustrated in FIG. 4B, the vessel 402 may include a ridge 404 at or near a proximal rim 406 of the vessel 402 for engaging the seal 204. The ridge 404 may protrude into an interior space of the vessel. In some embodiments, the ridge 404 may be a threaded portion to engage with a threaded seal of the first portion 102 or the second portion 104.

In other embodiments, the ridge 404 may be a protrusion to engage an O-ring seal. For example, the ridge may be coupled to a groove 408 defined by an inner surface 410 of the vessel 402 at or near the proximal rim 406 in which the O-rings may engage the inner surface 410 of the vessel 402. The groove 408 may adjoin a side of the ridge 404 nearest the distal end (not shown) of the vessel 402 opposite the proximal rim 406 in a sine wave configuration with the ridge 406.

Either of the first portion 102 or the second portion 104 may engage the proximal rim 406. For example, the proximal rim 406 may have a dimension, e.g., a diameter, equal to $d_1$ and $d_3$, which are substantially equal to each other. The first portion 102 may therefore directly engage the proximal rim 406 or the second portion 104 may directly engage the proximal rim 406.

Removal of the first portion 102 from the second portion 104 may require less force than removal of the second portion 104 from vessel 402. For example, the proximal rim 406 and/or groove 408 may engage the second portion 104 more tightly than the second portion 104 engages the first portion 102.

With further reference to FIG. 3, the baffle 304 may have a toroidal configuration. A toroid as used herein may refer to a shape having a circular cross-section, a diamond cross-section, a rectangular cross-section, a polygonal cross-section, etc. The shape is substantially consistent around a central axis. For example, a toroid having a circular cross-section may resemble a doughnut. It is not necessary however, that the baffle be completely circular but rather may follow the shape of the inner surface of a vessel or collar in which it is attached.

In some embodiments, the baffle 304 may be a partial toroid. For example, in a toroid having a circular cross-section, the cross-section may be a half or partial circle that is revolved about a central axis. Thus, in the present example embodiment, the baffle 304 may be a concavity with a central vent, e.g., a doughnut hole, in a middle region of the toroid. It is not required, however, that the concavity be circular but may instead be rectilinear or randomly arcuate.

The baffle 304 may prevent liquid from escaping the vessel 402 while the first through-hole allows vapor to escape the vessel 402. For example, liquid may be more likely to be displaced along the sides of a vessel rather than directly up through the center of a vessel. With the exception of the second through-hole 316, the baffle 304 may be completely attached to the inner wall of a vessel, collar, or lid to prevent fluid and vapor from escaping the vessel. Therefore, as liquid within the container is vertically displaced, the baffle 304 impedes fluid flow along the sides of the vessel.

In a direction of the second through-hole 316, the baffle 304 may be sloped toward a bottom of the vessel from, for example, the proximal edge 332 (if the baffle 304 is in a collar) or, for example, from a proximal rim of the vessel. Thus, for example, fluid that is displaced along the interior wall of a vessel and splashes onto the baffle 304 may be redirected back into the vessel. Vapor from fluid within the vessel may nonetheless escape through the first through-hole 314.

In some embodiments, a third portion (not shown) such as a lid, cap, plug, tab, or cover, substantially equivalent to the size of the first through-hole 314, may be placed directly over or under the first through-hole 314. Thus, additional protection from splashes through the first through-hole 314 may be provided by the third portion.

Figure 5:
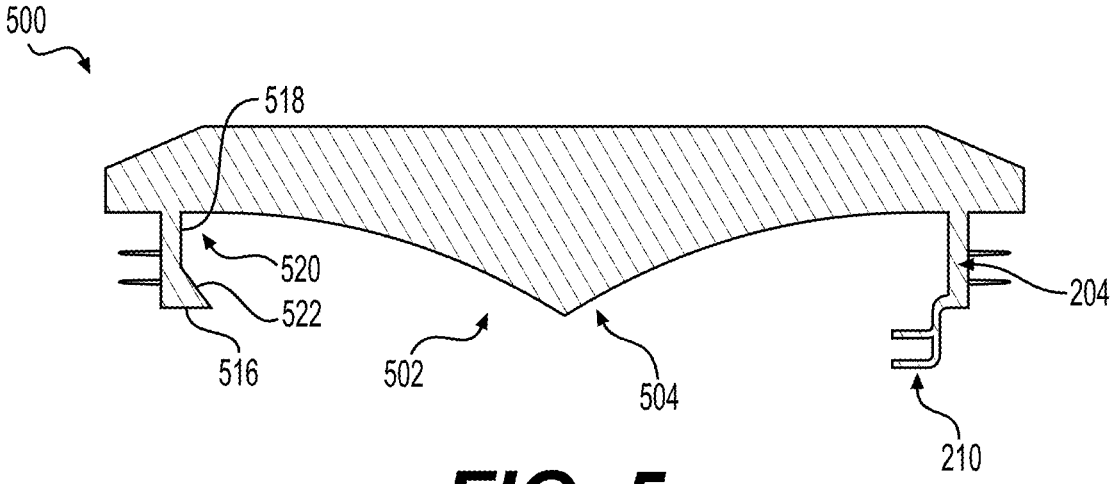
FIG. 5 illustrates a cross-sectional view of a further embodiment of the first portion illustrated in FIG. 1.

FIG. 5 illustrates a further embodiment 500 of a first portion, which may include an inner surface 502, a projection 504, a condensation barrier 516 and an inner collar surface 518. The condensation barrier 516 along with the inner collar surface 518 and at least an edge region of the inner surface 502 may define a condensation cavity 520.

The projection 504 may be any of a mound, a cone, a pyramid, an elongate body, etc. The projection 504 may project from the inner surface 502 of the first portion 500 toward a distal end of the vessel. In some embodiments, a plurality of projections may project from the inner surface 502 toward the distal end of the vessel. The plurality of projections may be equally spaced apart, or they may be randomly spaced apart and they may all be similarly shaped or randomly shaped.

The projection 504 may help to prevent condensation from collecting on the inner surface 502 of the first portion 500. For example, condensation from hot beverages within the vessel may gather on the projection and release onto the baffle or back into the vessel. Thus, if the first portion 500 is locked onto the second portion 104, condensation on the inner surface 502 is reduced and/or altogether eliminated.

For any condensation that collects on the inner surface 502, it may collect in the condensation cavity 520 when the first portion 500 is attached to a vessel or a second portion by the clip 210. Condensation may be prevented from escaping the condensation cavity 520 by the condensation barrier 516. The condensation barrier may include a sloped surface 522 that allows condensation to be expelled from the condensation cavity 520 when the first portion 500 is attached to a vessel or a second portion as a lid.

Figure 6:
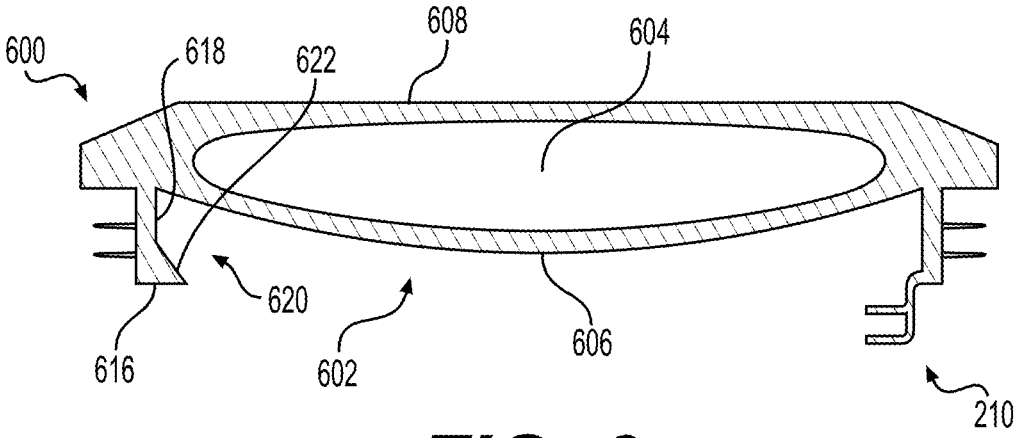
FIG. 6 illustrates a cross-sectional view of another embodiment of the first portion illustrated in FIG. 1.

FIG. 6 illustrates a further embodiment 600 of a first portion, which may include an inner surface 602, a projection 606, a condensation barrier 616 and an inner collar surface 618. The condensation barrier 616 along with the inner collar surface 618 and at least an edge region of the inner surface 602 may define a condensation cavity 620.

A compartment 604 may be defined by a proximal surface 608 and an inner surface 602. The compartment 604 may help to reduce condensation on the inner surface 602. For example, the presence of a lid having a temperature lower than a temperature within the vessel promotes vapor condensation on an interior surface of the lid. The compartment 604 may help maintain the inner surface 602 of the lid at temperature higher than a temperature of cooler air outside of the vessel. For example, the inner surface 602 may be substantially warmer than the proximal surface 608 due to the presence of the compartment 604.

For any condensation that collects on the inner surface 602, it may collect in the condensation cavity 620 when the first portion 600 is attached to a vessel or a second portion by the clip 210. Condensation may be prevented from escaping the condensation cavity 620 by the condensation barrier 616. The condensation barrier may include a sloped surface 622 that allows condensation to be expelled from the condensation cavity 620 when the first portion 600 is attached to a vessel or a second portion as a lid.

Some embodiments may include a combination of one or more projections 606 and one or more compartments 604 to further reduce condensation from the inner layer 602. The compartment 604 may be filled with any insulating means with low heat transfer capability such as air, a vacuum, cork, ceramic, etc.

Figure 7A:
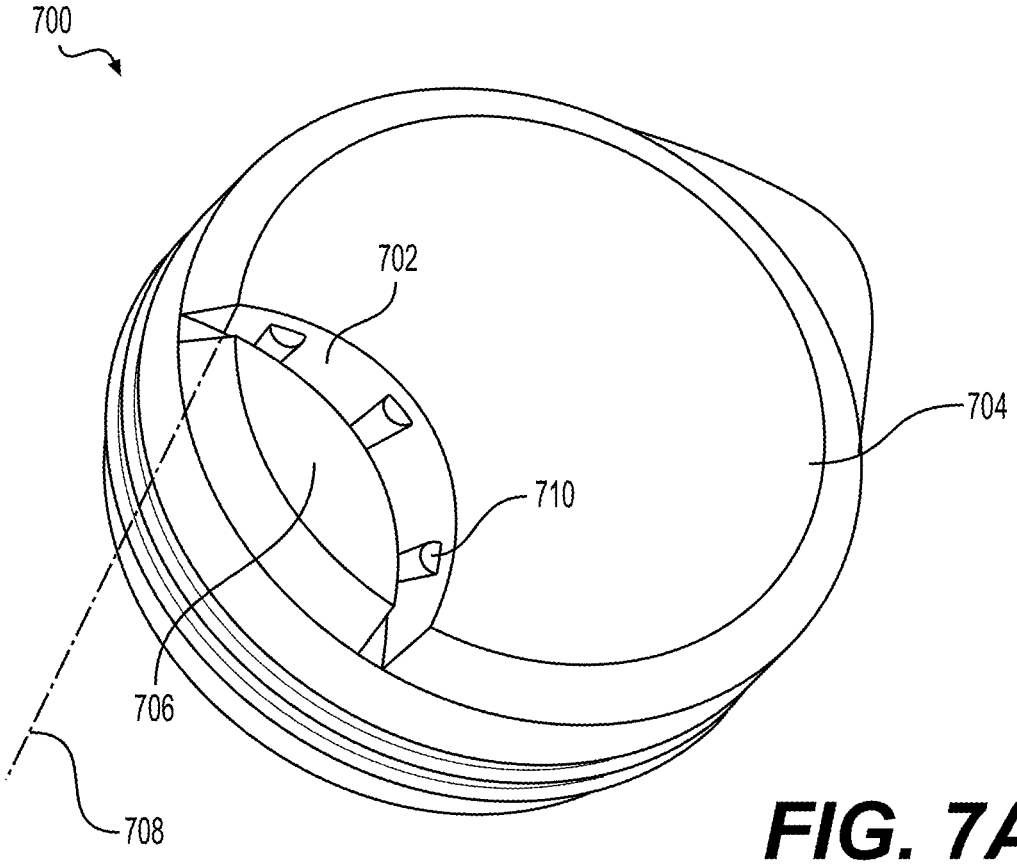
FIGS. 7A-7D illustrate a further embodiment of a first portion of a lid.
Figure 7B:
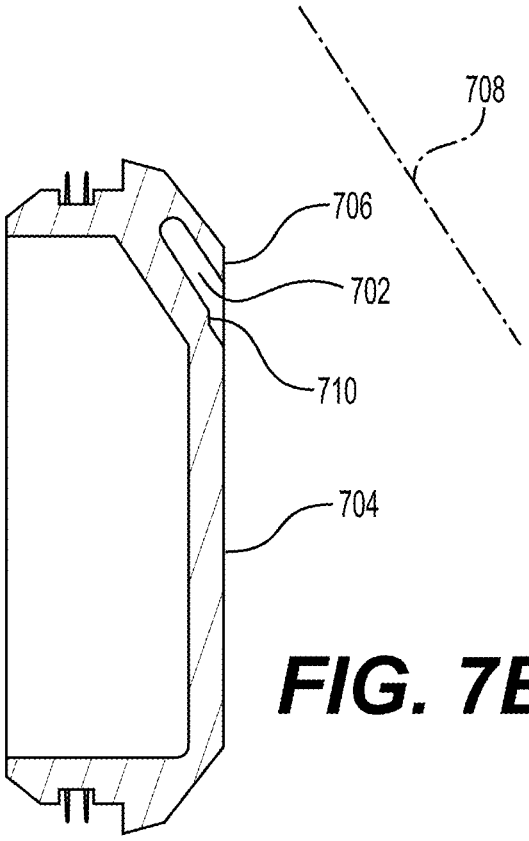

In some embodiments, as shown in FIGS. 7A and 7B, a first portion 700 may include a lid recess 702 defined in a proximal surface of the first portion 700. For example, a first section 704 of the first portion 700 may be a body section and a second section 706 may be a prong section. The body section 704 and the prong section 706 may have surfaces that have similar curvatures. Any and/or all curves in the body section 704 and the prong section 706 may be about a common axis 708 substantially parallel with each other or any and all curves in the body section 704 and the prong section 706 may substantially irregularly correspond with each other.

Figure 7C:
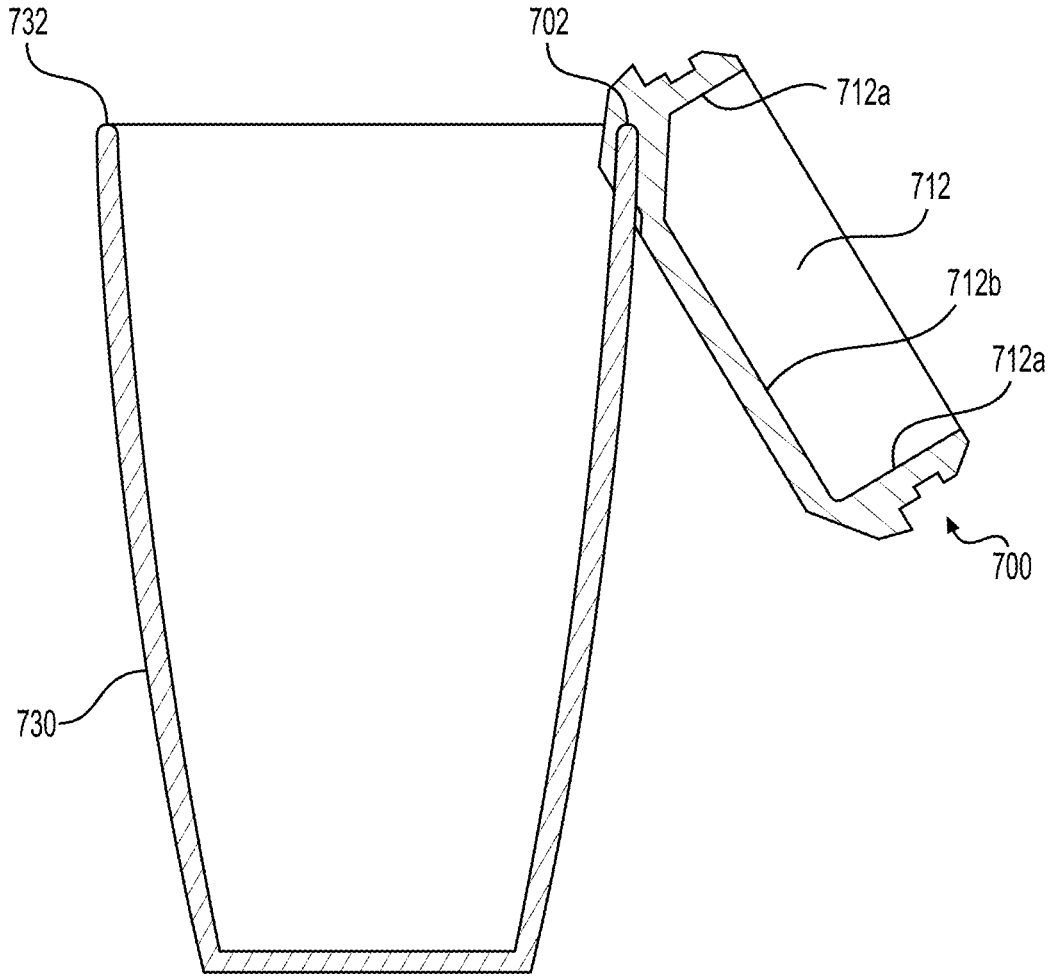

As illustrated in FIG. 7C, the lid recess 702 may be configured to clip the first portion 700 to a vessel or to the second portion 104. For example, the body section 704 and the prong section 706 forming the lid recess 702 may engage the proximal edge 332 of the second portion 104 in a clamping/clipping action to fix the lid to the second portion 104. In this configuration, condensation that may have gathered on an interior surface of the first portion 700 may be retained in the first portion 700 during a tilting, i.e., drinking action of the vessel. When the first portion 700 is clipped to a vessel, the interior of the first portion 700 may be a well 712 that collects vapor that has condensed on the interior of the first portion 700. The well may be defined by interior wall 712*a* and proximate surface 712*b* of the first portion 700.

Clipping action may be promoted by a spring 740, e.g., helical spring, a leaf spring, a torsion spring, etc. For example, the prong section 706 may be attached to the first portion 700 via a hinge (not shown) and urged toward the body via the spring, which is connected to the body section 704 and/or the prong section 706.

The lid recess 702 may be configured to immovably attach the first portion 700 to the vessel 730 or the second section 104. For example, in some embodiments, the lid recess 702 may have an average radius of curvature that is smaller or larger than the average radius of curvature of a proximate rim 732 of the vessel 730 or of the second portion 104. In alternative embodiments, the lid recess 702 may include at least one rib 710, projecting into the lid recess 702 from the body section 704 or from the prong section 706, that directly contacts the vessel 730 or second portion 104 when the first portion 700 is in contact with the vessel 730 or second portion 104. The rib 710 may have a cross-section that is cylindrical, rectangular, triangular, hexagonal, polygonal, etc. In alternative embodiments, the rib 710 may have a substantially constant cross-section along an entire length of the rib 710. In yet further alternative embodiments, the rib 710 may have a varying cross-section along the entire length of the rib 710. In other embodiments, the clamping/clipping function performed by the rib 710 may be performed by a semi-spherical projection or by a spring-loaded member.

Figure 7D:
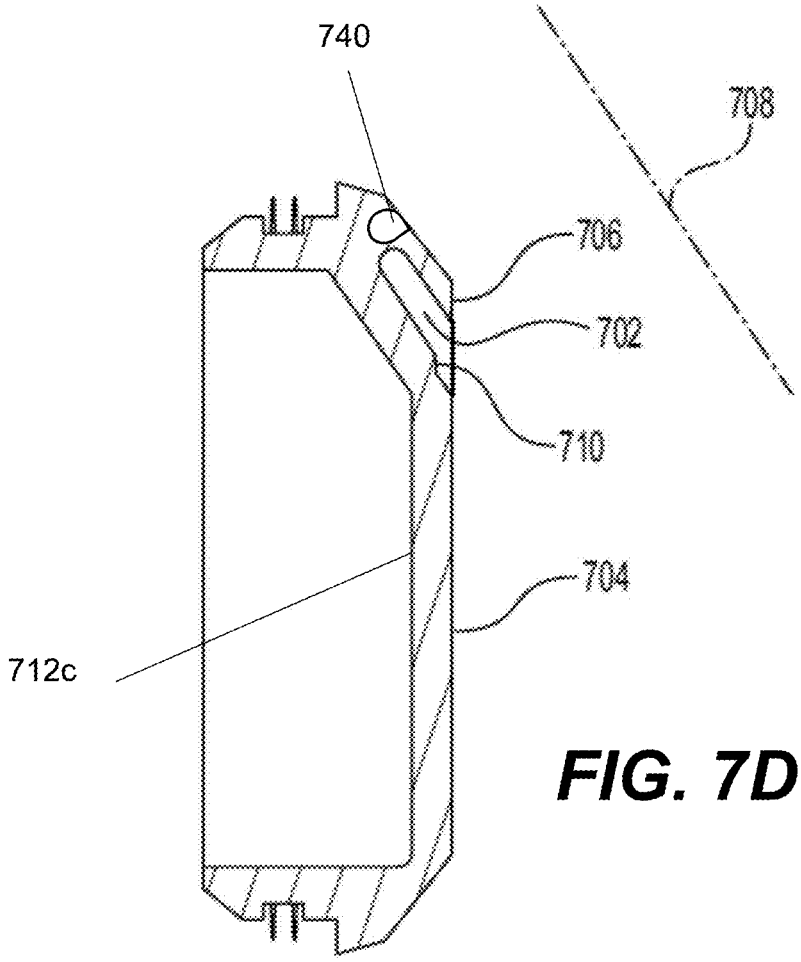

With further reference to FIG. 7C-7D, the ribs 710 may be oriented such that a longitudinal axis of the ribs 710 within the lid recess 702 intersects the proximal surface 712*b*, i.e., the longitudinal axis of the ribs 710 is substantially perpendicular to a line passing through the plane containing the proximal surface 712*b*. For example, the first portion 700 may include a substrate 718 that includes the proximal surface 712*b* on a first side thereof and may also include a distal surface 712*c* on a second side thereof. The proximal surface 712*b* may be on a side of the first portion that is opposite of the distal surface 712*c*. I.e., the proximal surface 712*b* faces a direction that is one hundred and eighty degrees away from the direction that the distal surface 712*c* is facing. A longitudinal axis of the ribs 710, therefore, would be perpendicular to a line passing through the proximal surface 712b and the distal surface 712*c*. As shown in FIG. D, a longitudinal axis of the ribs may be slanted, i.e., oblique or askew, relative to the proximal surface 712*b* and the distal surface 712*c*. As further shown in FIG. 7C-7D, the longitudinal axis of the rib may be substantially parallel to common axis 708, which is slanted, i.e., oblique or askew relative to the proximal surface 712*b* and the distal surface 712*c*.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A lid for a container comprising:

a substrate having a first surface and a proximate surface, the first surface being on a side of the substrate facing a direction diametrically opposite a direction of the proximate surface;

a rim coupled to the first surface of the substrate;

a groove defined by the proximate surface of the substrate, the defined groove having a first arcuate surface and a second arcuate surface that opposes, about the defined groove, the first arcuate surface and each arcuate surface being coaxial about a common central axis that is tilted relative to the first surface and the proximate surface; and a rib on the first arcuate surface and having a longitudinal axis oriented parallel to the first arcuate surface and the longitudinal axis further oriented to intersect the first surface and the proximate surface;

a prong section attached to the first substrate via a spring and biases the defined grooved towards or away from a closed position.

2. The lid as recited in claim 1, wherein the proximate surface further defines a plurality of ribs extending into the defined groove.

3. The lid as recited in claim 2, wherein each of the plurality of ribs is oriented parallel to an adjacent rib.

4. The lid as recited in claim 3, wherein the plurality of ribs have a longitudinal axis that is parallel to the first arcuate surface of the substrate.

5. The lid as recited in claim 1, wherein the defined groove is arcuate and configured to receive a rim of a drinking vessel.

6. The lid as recited in claim 5, wherein the defined groove is located between an edge of the proximate surface and a geometric center of the proximate surface.

7. The lid as recited in claim 6, wherein the defined groove connects to the edge of the proximate surface at two mutually exclusive points.

8. The lid as recited in claim 7, wherein the defined groove and the edge of proximate surface forms an ovular shape between the defined groove and the edge of the proximate surface.

9. A container comprising:

a body; and a lid configured to be received in the body in a watertight relationship, the lid having, a substrate having a first surface and a proximate surface, the first surface being on a side of the substrate facing a direction diametrically opposite a direction of the proximate surface;

a rim coupled to the first surface of the substrate;

a groove defined by the proximate surface of the substrate, the defined groove having a first arcuate surface and a second arcuate surface that opposes, about the defined groove, the first arcuate surface and each arcuate surface being coaxial about a common central axis that is tilted relative to the first surface and the proximate surface;

a rib on the first arcuate surface and having a longitudinal axis oriented parallel to the first arcuate surface and the longitudinal axis further oriented to intersect the first surface and the proximate surface;

a prong section attached to the first substrate via a spring and biases the defined grooved towards or away from a closed position.

10. The container as recited in claim 9, wherein the proximate surface further defines a plurality of ribs extending into the defined groove.

11. The container as recited in claim 10, wherein each of the plurality of ribs is oriented parallel to an adjacent rib.

12. The container as recited in claim 11, wherein the plurality of ribs have a longitudinal axis that is parallel to the first arcuate surface of the substrate.

13. The container as recited in claim 9, wherein the defined groove is arcuate and configured to receive a rim of a drinking vessel.

14. The container as recited in claim 13, wherein the defined groove is located between an edge of the proximate surface and a geometric center of the proximate surface.

15. The container as recited in claim 14, wherein the defined groove connects to the edge of the proximate surface at two mutually exclusive points.

16. The container as recited in claim 15, wherein the defined groove and the edge of proximate surface forms an ovular shape between the defined groove and the edge of the proximate surface.

* * * * *